US012188342B2

(12) United States Patent
Zhan et al.

(10) Patent No.: US 12,188,342 B2
(45) Date of Patent: Jan. 7, 2025

(54) INTELLIGENT DRILLING SYSTEM WITH EXTERNAL STATIONARY SENSING SHIELD

(71) Applicant: SAUDI ARABIAN OIL COMPANY, Dhahran (SA)

(72) Inventors: Guodong Zhan, Dhahran (SA); Chinthaka P. Gooneratne, Dhahran (SA); Abdulwahab Aljohar, Dhahran (SA); Jianhui Xu, Dhahran (SA); Timothy Eric Moellendick, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 118 days.

(21) Appl. No.: 18/064,105

(22) Filed: Dec. 9, 2022

(65) Prior Publication Data

US 2024/0191612 A1 Jun. 13, 2024

(51) Int. Cl.
*E21B 44/06* (2006.01)
*E21B 21/08* (2006.01)

(52) U.S. Cl.
CPC ..... *E21B 44/06* (2013.01); *E21B 21/08* (2013.01)

(58) Field of Classification Search
CPC ..... E21B 44/005; E21B 44/02; E21B 44/06; E21B 21/08; E21B 4/003; E21B 4/02; E21B 47/00
See application file for complete search history.

(56) References Cited

U.S. PATENT DOCUMENTS

| | | | | |
|---|---|---|---|---|
| 6,179,066 | B1 | 1/2001 | Nasr | |
| 11,131,144 | B1 * | 9/2021 | Althowiqeb | E21B 31/035 |
| 2001/0042643 | A1 * | 11/2001 | Krueger | E21B 17/1014 175/73 |
| 2008/0073123 | A1 * | 3/2008 | Mullins | E21B 17/22 175/323 |
| 2010/0200295 | A1 | 8/2010 | Schimanski | |

FOREIGN PATENT DOCUMENTS

| | | | |
|---|---|---|---|
| EP | 1159506 | A1 | 12/2001 |
| WO | 2015179307 | A1 | 11/2015 |
| WO | 2017087490 | A1 | 5/2017 |

OTHER PUBLICATIONS

International Search Report and Written Opinion issued in Application No. PCT/US2023/082737, mailed on Mar. 11, 2024 (14 pages).

* cited by examiner

*Primary Examiner* — Kristyn A Hall
(74) *Attorney, Agent, or Firm* — Osha Bergman Watanabe & Burton LLP

(57) ABSTRACT

An intelligent drilling system is disclosed. The intelligent drilling system includes an inner drill pipe adapted to rotate around a longitudinal axis in a transversal plane of a wellbore to advance a drill bit during a drilling operation, an external drill string shield surrounding the inner drill pipe and coupled to the inner drill pipe via at least one bearing system, the at least one bearing system adapted to decouple the external drill string shield from a rotational motion of the inner drill pipe in the transversal plane such that the external drill string shield remains substantially stationary during the drilling operation, and an in-situ sensing system disposed on an interior wall of the external drill string shield to measure at least one downhole parameter of the wellbore.

17 Claims, 5 Drawing Sheets

INTELLIGENT DRILLING SYSTEM WITH EXTERNAL STATIONARY SENSING SHIELD

BACKGROUND

There are many challenges in the oil and gas drilling industry. For example, poor borehole cleaning may cause excessive torque and drag, resulting in a stuck pipe, downhole pressure changes may lead to mud loss and formation damage, resulting in collapse and loss of boreholes, and extended wells may need to upgrade to large capacity drilling rigs due to the hole cleaning and instability concern. Downhole conditions, such as temperature, pressure, cuttings evaluation, torque, drag, vibration, etc., are important to be considered in intelligent drilling and drilling automation. Such information is typically collected by logging while drilling (LWD), measurement while drilling (MWD) or other sensor tools of the bottom hole assembly (BHA). These LWD, MWD or sensor tools are rotated together with the BHA. In some cases, the rotation is beneficial to measure downhole parameters in the drill string, such as torque, drag, vibration, etc. However, the rotation at high speed may hinder the accurate measurement of other downhole parameters, such as temperature, pressure, in-situ cuttings evaluation, etc.

SUMMARY

In general, in one aspect, the invention relates to an intelligent drilling system. The intelligent drilling system includes an inner drill pipe adapted to rotate around a longitudinal axis in a transversal plane of a wellbore to advance a drill bit during a drilling operation, an external drill string shield surrounding the inner drill pipe and coupled to the inner drill pipe via at least one bearing system, the at least one bearing system adapted to decouple the external drill string shield from a rotational motion of the inner drill pipe in the transversal plane such that the external drill string shield remains substantially stationary during the drilling operation, and an in-situ sensing system disposed on an interior wall of the external drill string shield to measure at least one downhole parameter of the wellbore.

In general, in one aspect, the invention relates to a rig for drilling a wellbore. The rig includes a drilling fluid tank for storing drilling fluids, and an intelligent drilling system that includes an inner drill pipe adapted to rotate around a longitudinal axis in a transversal plane of a wellbore to advance a drill bit during a drilling operation, an external drill string shield surrounding the inner drill pipe and coupled to the inner drill pipe via at least one bearing system, the at least one bearing system adapted to decouple the external drill string shield from a rotational motion of the inner drill pipe in the transversal plane such that the external drill string shield remains substantially stationary during the drilling operation, and an in-situ sensing system disposed on an interior wall of the external drill string shield to measure at least one downhole parameter of the wellbore, wherein the drilling fluids flow downward from the drilling fluid tank through the inner drill pipe to the drill bit, wherein the drilling fluids flow upward to return to the drilling fluid tank through an inner annular passage between the inner drill pipe and the external drill string shield and an outer annular passage between the external drill string shield and an interior wall of the wellbore, and wherein the in-situ sensing system measures the at least one downhole parameter from the drilling fluids flowing through the inner annular passage.

In general, in one aspect, the invention relates to a system that includes a wellsite having a wellbore penetrating a subterranean formation in a field and a rig for drilling the wellbore. The rig includes a drilling fluid tank for storing drilling fluids, and an intelligent drilling system that includes an inner drill pipe adapted to rotate around a longitudinal axis in a transversal plane of a wellbore to advance a drill bit during a drilling operation, an external drill string shield surrounding the inner drill pipe and coupled to the inner drill pipe via at least one bearing system, the at least one bearing system adapted to decouple the external drill string shield from a rotational motion of the inner drill pipe in the transversal plane such that the external drill string shield remains substantially stationary during the drilling operation, and an in-situ sensing system disposed on an interior wall of the external drill string shield to measure at least one downhole parameter of the wellbore, wherein the drilling fluids flow downward from the drilling fluid tank through the inner drill pipe to the drill bit, wherein the drilling fluids flow upwards to return to the drilling fluid tank through an inner annular passage between the inner drill pipe and the external drill string shield and an outer annular passage between the external drill string shield and an interior wall of the wellbore, and wherein the in-situ sensing system measures the at least one downhole parameter from the drilling fluids flowing through the inner annular passage. The system further includes a data gathering and analysis system configured to facilitate the drilling operation based on the at least one downhole parameter measured by the in-situ sensing system.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms “before”, “after”, “single”, and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein include an intelligent drilling system having an inner drill pipe and an external drill string shield. During drilling, the inner drill pipe rotates and drives the drill bit to cut the formation. The external drill string shield is coupled to the rotating inner drill pipe via one or more bearing systems such that the external drill string shield is not rigidly coupled to the rotational motion of the inner drill pipe. In other words, the external drill string shield is more "stationary" than the rest of BHA, so that downhole parameters can be measured with more accuracy. One or more in-situ sensing systems are attached to the interior of the external drill string shield. Each in-situ sensing system includes sensor(s), data communication module(s), and power module(s). Sensor measurements of downhole conditions, such as temperature, pressure, in-situ cuttings evaluation, etc. are promptly transmitted to the surface, either by a wired connection or a wireless connection. The bearing systems reduce, if not eliminate, any rotational motion of the sensor(s) and the external drill string shield when the inner drill pipe is rotating. Accordingly, the downhole conditions are measured more accurately compared to the conventional LWD/MWD tools or other sensing tools that rotates with the BHA during drilling.

Figure 1:
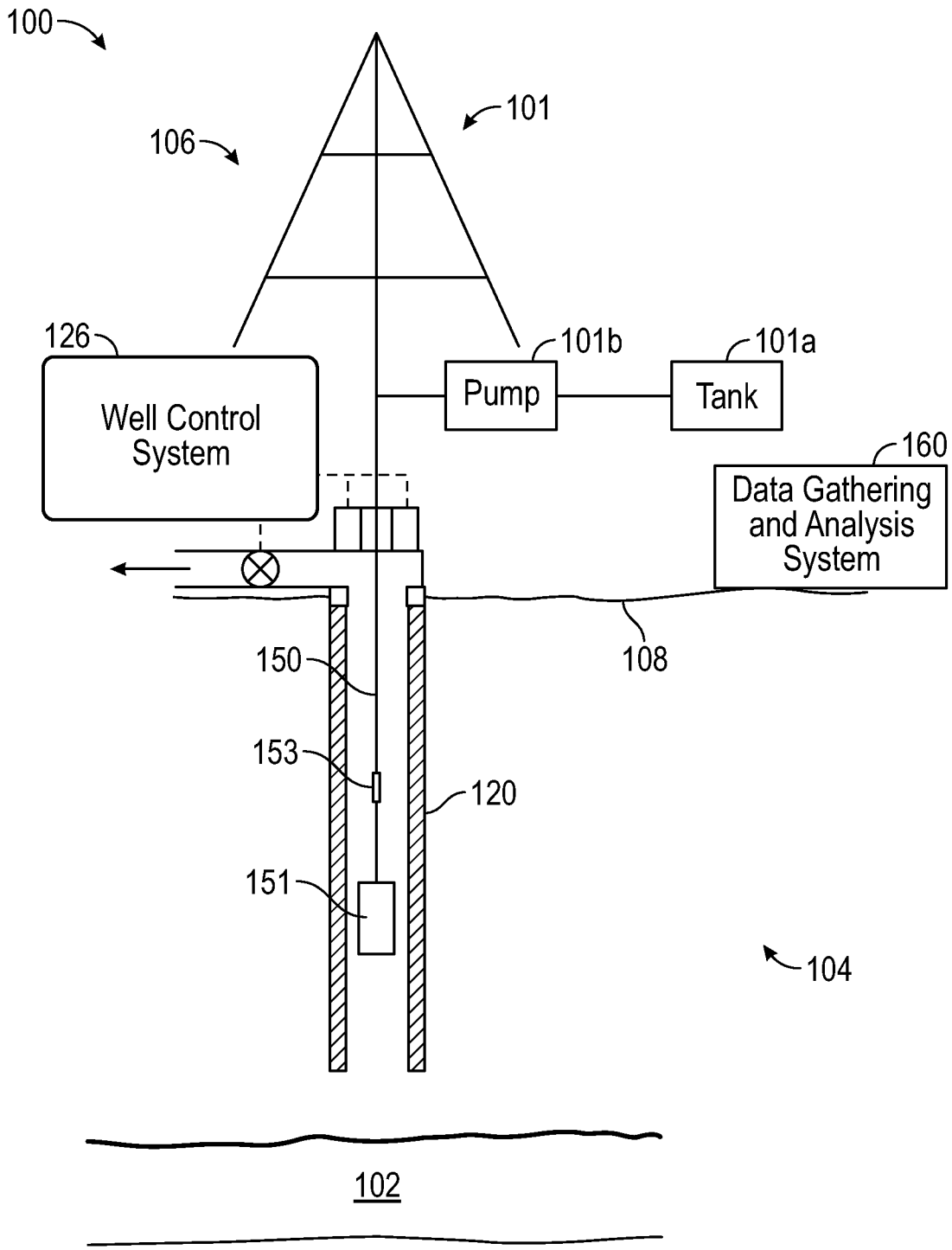
FIG. 1 shows a well system in accordance with one or more embodiments.

FIG. 1 shows a schematic diagram of a well environment in accordance with one or more embodiments. In one or more embodiments, one or more of the modules and/or elements shown in FIG. 1 may be omitted, repeated, and/or substituted. Accordingly, embodiments disclosed herein should not be considered limited to the specific arrangements of modules and/or elements shown in FIG. 1.

As shown in FIG. 1, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a data gathering and analysis system (160), and a well control system ("control system") (126). The well control system (126) may control various operations of the well system (106), such as well production operations, well drilling operation, well completion operations, well maintenance operations, and reservoir monitoring, assessment and development operations. In some embodiments, the well control system (126) includes a computer system.

The rig (101) is the machine used to drill a borehole to form the wellbore (120). Major components of the rig (101) include the drilling fluid tanks (e.g., tank (101*a*)), the drilling fluid pumps (e.g., pump (101*b*)), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells.

In some embodiments, a bottom hole assembly (BHA) (151) is attached to the drill string (150) to suspend into the wellbore (120) for performing the well drilling operation. Downhole sensors, e.g., downhole sensor (153), are provided in the wellbore (120) to measure downhole conditions. The sensor measurements may include temperature data, pressure data, in-situ cuttings evaluation data, etc. The bottom hole assembly (BHA) is the lowest part of the drill string (150) and includes the drill bit, drill collar, stabilizer, mud motor, etc. In one or more embodiments, the drill string (150) is constructed as an intelligent drilling system where the downhole sensor (153) is part of the intelligent drilling system.

The wellbore (120) includes a bored hole (i.e., borehole) that extends from the surface (108) towards a target zone of the formation (104), such as the reservoir (102). The wellbore (120) may be drilled for exploration, development and production purposes. The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of logging tools lowered into the formation (104) or the reservoir (102) during logging operations. The wellbore (120) may be logged by lowering a combination of physical sensors downhole to acquire data that measures various rock and fluid properties, such as irradiation, density, electrical and acoustic properties. The acquired data may be organized in a log format and referred to as well logs or well log data.

In some embodiments, the data gathering and analysis system (160) includes hardware and/or software with functionality for facilitating operations of the well system (106), such as well production operations, well drilling operation, well completion operations, well maintenance operations, and reservoir monitoring, assessment and development operations. For example, the data gathering and analysis system (160) may communicate with the downhole sensor (153) to retrieve and analyze sensor measurements to facilitate the operations of the well system (106), such as the drilling operation. For example, the data gathering and analysis system (160) may generate control signals, based on the analysis results of the sensor measurements, for the well control system (126) to control the drilling operation in real time. While the data gathering and analysis system (160) is shown at a well site, embodiments are contemplated where at least a portion of the data gathering and analysis system (160) is located away from well sites. In some embodiments, the data gathering and analysis system (160) may include a computer system that is similar to the computing device (400) described below with regard to FIG. 4 and the accompanying description.

Figure 2A:
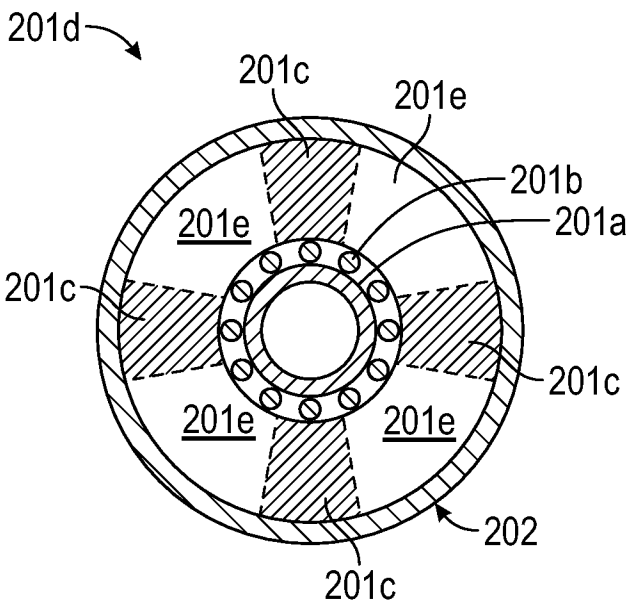
FIGS. 2A, 2B, and 2C show schematic diagrams of a drilling system in accordance with one or more embodiments.
Figure 2A:
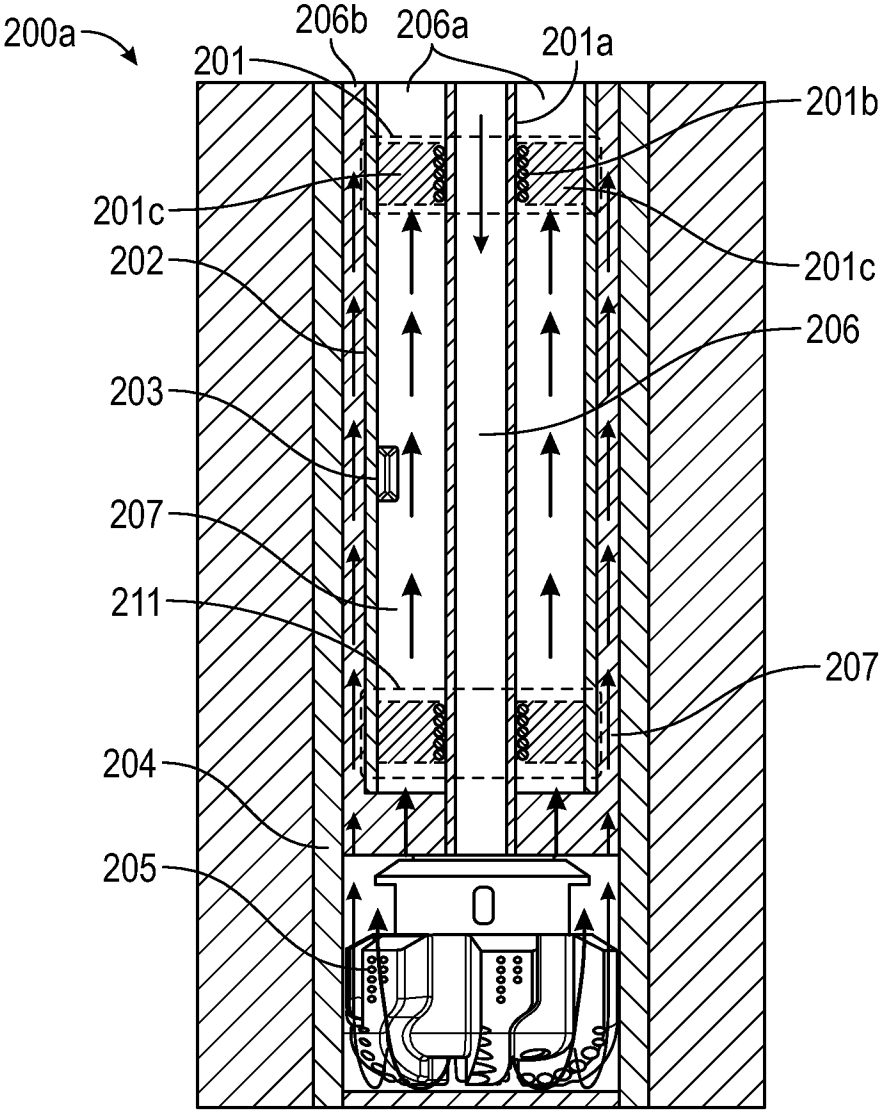
Figure 2B:
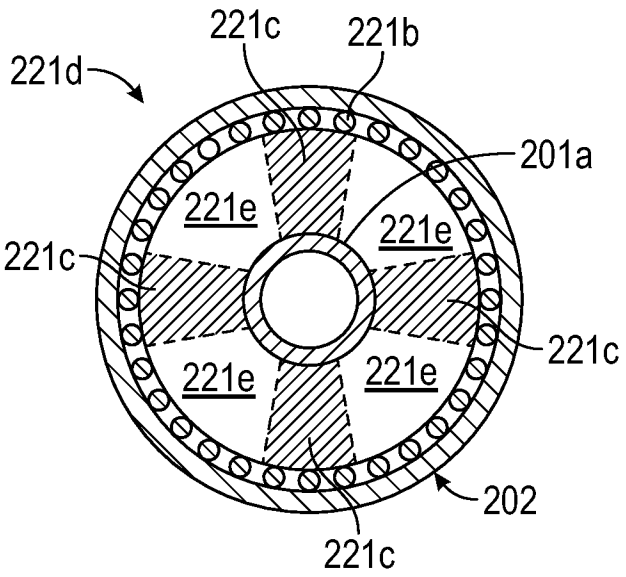
Figure 2B:
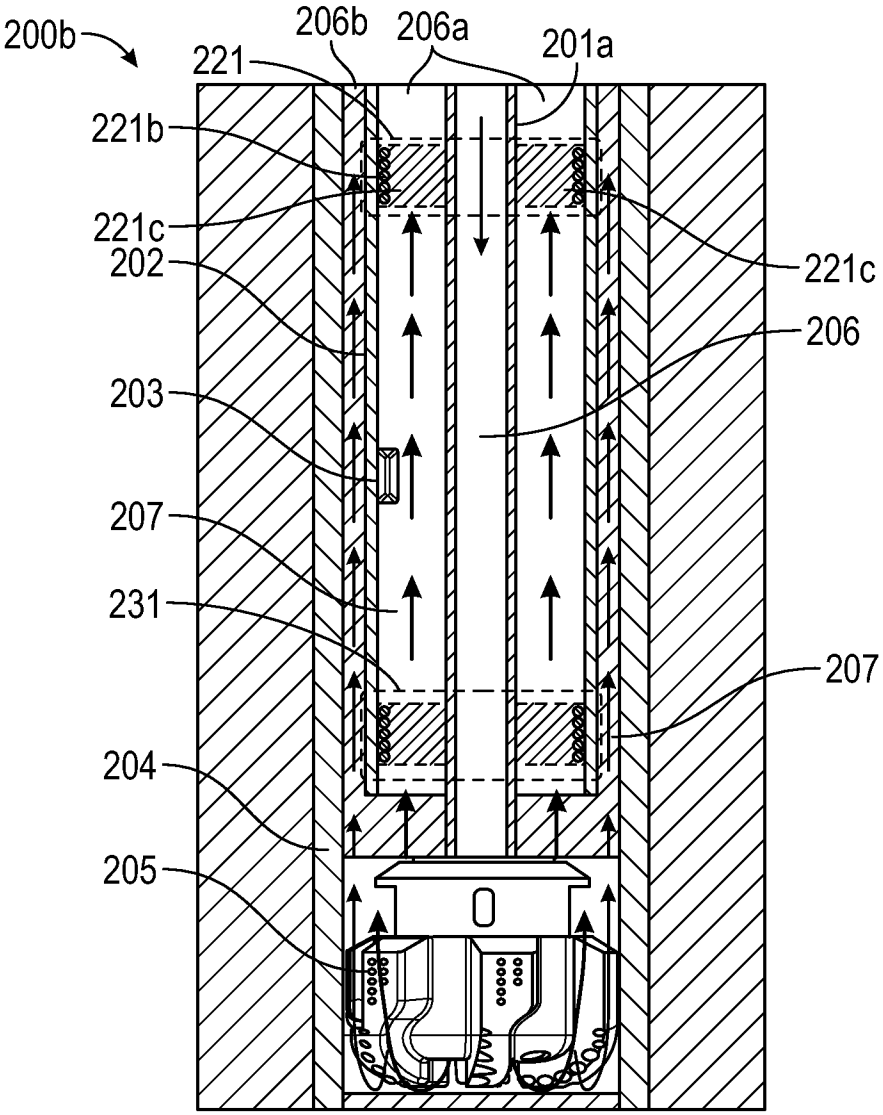
Figure 2C:
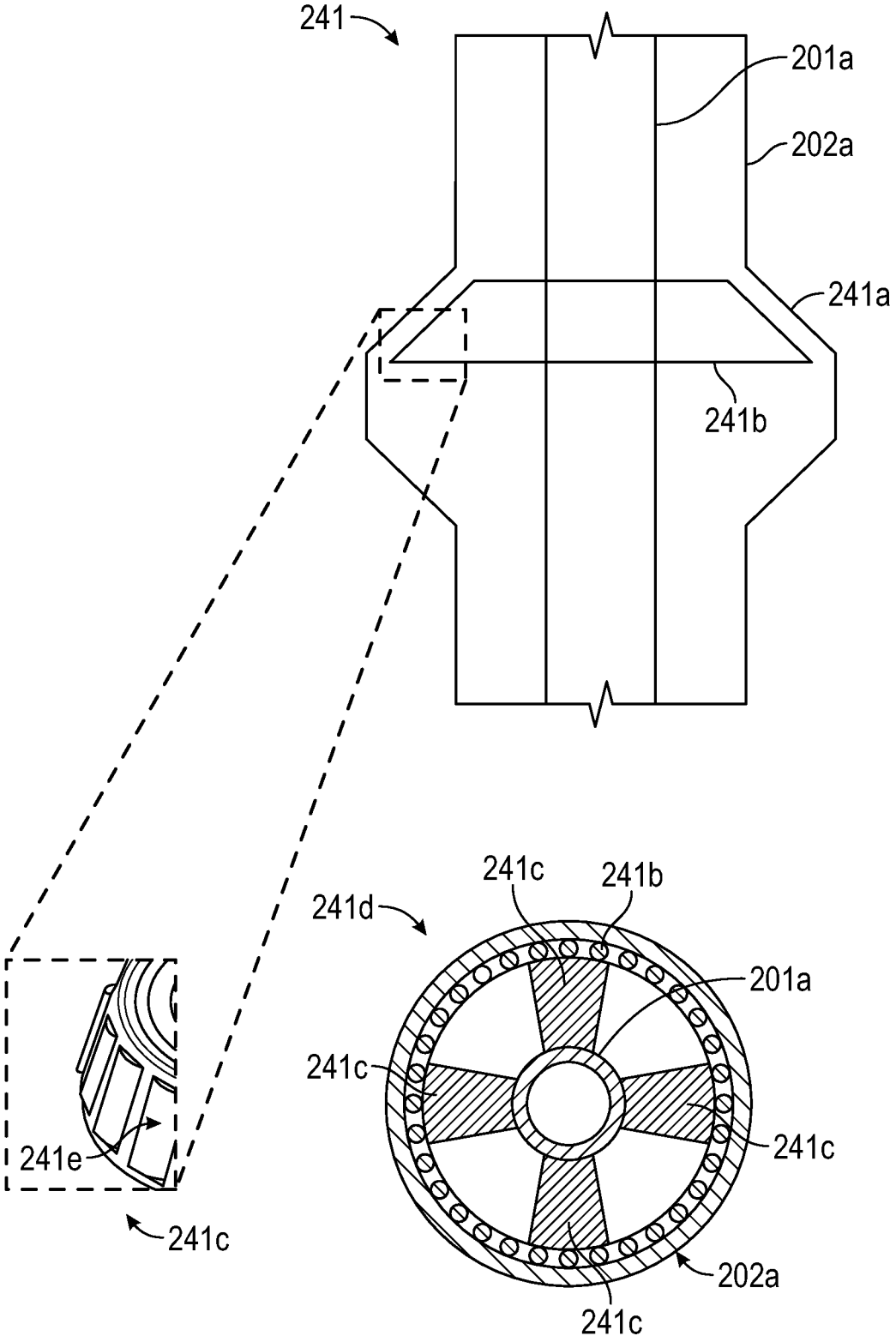

FIGS. 2A-2C show schematic diagrams of a drilling system in accordance with one or more embodiments. In particular, FIGS. 2A-2C illustrate an intelligent drilling system with advanced downhole sensing systems attached to an external drill string shield (202) that remains substantially stationary during drilling. Throughout this disclosure, the term "substantially stationary" refers to motions in a transversal plane of the intelligent drilling system. Specifically, the term "substantially stationary" means either stationary or rotating, in the transversal plane, at less than a fraction (e.g., 1/10, 1/100, etc.) of the RPM (rotations per minute) of the drill bit. In this context, being substantially stationary does not preclude a linear motion along the longitudinal direction of the intelligent drilling system. In other words, the term "substantially stationary" is synonymous with "substantially non-rotational." With the advanced downhole sensing systems being substantially stationary, real-time sensor data collections are more reliable for drilling automation. In one or more embodiments, one or more of the modules and/or elements shown in FIGS. 2A-2C may be omitted, repeated, and/or substituted. Accordingly, embodiments of the invention should not be considered limited to the specific arrangements of modules and/or elements shown in FIGS. 2A-2C.

As shown in FIG. 2A, the intelligent drilling system A (200*a*) includes an inner drill pipe (201*a*) surrounded by an external drill string shield (202) that are coaxial to each other within the borehole defined by the wellbore wall (204). The external drill string shield (202) is a pipe that separates the annular space between the wellbore wall (204) and the inner drill pipe (201*a*) into an inner annular passage (206*a*) and an outer annular passage (206*b*). The inner drill pipe (201*a*) is connected to a drill bit (205) and rotates around a longitudinal axis to drive the drill bit (201*a*) during drilling. The in-situ sensing system (203) is attached to the interior wall of the external drill string shield (202) to measure various parameters of the drilling fluids. The flow of the drilling fluids (206) is indicated by downward arrows inside the inner drill pipe (201*a*), and indicated by upward arrows inside the inner annular passage (206*a*) and the outer annular passage (206*b*). In one or more embodiments, the passages for the drilling fluid flows provided by the intelligent drilling system A (200*a*) are more than 50% of the cross-section area of the wellbore so that the generic flow of the drilling fluid is not significantly affected comparing to conventional drilling systems.

During drilling, cuttings (207) created by the drill bit (205) are carried by drilling fluids to the Earth's surface. The drilling fluids flowing through the inner annular passage (206*a*) between the inner drill pipe (201*a*) and the external drill string shield (202) may include up to 90% of the total drilling fluid flow returning to the Earth surface. The high percentage is achieved by the design and selection of the external drill string shield dimensions to increase the amount of drilling fluids measured by the in-situ sensing system (203), such as for the in-situ cutting evaluation. On the other hand, the drilling fluids flowing through the outer annular passage (206*b*) between the external drill string shield (202) and the wellbore wall (204) may include as low as 10% of the total drilling fluid flow returning to the Earth's surface, mainly for lubrication to prevent the external drill string shield (202) from getting stuck in the wellbore.

The external drill string shield (202) is coupled to the inner drill pipe (201*a*) via at least a top bearing system (i.e., inner drill pipe bearing system A (201)) and a bottom bearing system (i.e., inner drill pipe bearing system B (211)). In some embodiments, the external drill string shield (202) and the inner drill pipe (201*a*) are further coupled in the longitudinal direction to advance together downward as the drilling progresses. For example, the external drill string shield (202) and the inner drill pipe (201*a*) may be coupled in the longitudinal direction via a tapered roller bearing described in FIG. 2C below. In another example, the external drill string shield (202) and the inner drill pipe (201*a*) may be coupled in the longitudinal direction via a linkage at the Earth surface. In the configuration shown in FIG. 2A, the inner drill pipe bearing system A (201) and the inner drill pipe bearing system B (211) have the same stationary rib construction as illustrated by the transversal cross-sectional view (201*d*). In particular, the cross-sectional view (201*d*) of the inner drill pipe bearing system A (201) shows that four ribs (201*c*) (referred to as bypass ribs) are fixed on the interior wall of the external drill string shield (202). Accordingly, the ribs (201*c*) remain substantially stationary with the external drill string shield (202) during drilling. The ribs (201*c*) protrude inwardly from the interior wall of the external drill string shield (202) to connect to the bearing (201*b*). The inner drill pipe (201*a*) acts as a shaft through the bearing (201*b*). The bearing (201*b*) includes rolling elements (e.g., ball, roller, etc.) to allow the external drill string shield (202) and the inner drill pipe (201*a*) to rotate freely with respect to each other. Gaps (201*e*) between the ribs (201*c*) allow the drilling fluids to flow through the inner annular passage (206*a*). For example, the gaps (201*e*) may occupy up to 60% of the cross-section area within the external drill string shield (202).

The in-situ sensing system (203) includes various sensors based on downhole applications, such as robot applications in drilling and completion. The sensors of the in-situ sensing system (203) are chosen based on various criteria, such as sensor type, accuracy, resolution, range, control interface, environmental condition, and calibration. These criteria are described below.

Sensor Type—Proximity sensors can detect the presence of objects, and there are several types of sensor technologies, including ultrasonic sensors, capacitive sensors, optoelectronics, inductive or magnetic sensors. Tracking objects can use proximity sensors (e.g. ultrasonic sensors) or, for advanced applications, image sensors (e.g. cameras) and visual software (e.g. OpenCV);

Accuracy—Accuracy is important when detecting and tracking objects, and it is useful to select sensors with precision values between the required measurement margins;

Resolution—high resolution detects minimal variations in the target position;

Range—involves selecting sensors according to measurement limits and comparing them with the range of detection required by the robot;

Control Interface—to interface the sensor you have to know the types of the sensors. A wide range of sensors are 3-wire DC types, but there are many more types including 2-wire DC or 2-wire AC/DC;

Environmental Condition—any sensor has its operational limits usually these are the temperature and humidity;

Calibration—calibrating the sensors is an essential step in to ensure efficiency and more accurate measurement.

Example sensors and sensor categories of the in-situ sensing system (203) are described below.

Proximity Sensor category—A variety of sensor technologies may be used to build proximity sensors: ultrasonic sensors, capacitive sensors, optoelectronics, inductive or magnetic sensors;

Motion detector category—These sensors are based on infrared light, ultrasonic or microwave/radar technology and may include gyroscopes;

Image sensor category—These are digital cameras, camera modules, and other imaging devices based on CCD or CMOS technology.

Light sensor: A light sensor can be included in the proximity sensor category, and it is a simple sensor that changes the voltage of Photoresistor or Photovoltaic cells in concordance with the amount of light detected. A light sensor is used in very popular applications for autonomous robots that track a line-marked path.

Color sensor: Different colors are reflected with different intensity, for example the orange color reflects red light in an amount greater than the green color. This simple sensor is in the same range with light sensor, but with a few extra features that can be useful for applications where the robot has to detect the presence of an object with a certain color, or to detect the types of objects or the surfaces.

Touch sensor: The touch sensor can be included in the proximity sensors category and are designed to sense objects at a small distance with or without direct contact. This sensor is designed to detect the changes in the capacitance between the on-board electrodes and the object making contact.

Ultrasonic sensor: These sensors are designed to generate high frequency sound waves and receive the echo reflected by the target. These sensors are used in a wide range of applications and are very useful when it is not important to detect of colors, surface texture, or transparency.

Infrared sensor: An infrared sensor measures the IR light that is transmitted in the environment to find objects by an IR LED. This type of sensor is very popular in navigation for object avoidance, distance measured or line following applications. This sensor is very sensitive to IR lights and sunlight, and this is the main reason that an IR sensor is used with great precision in spaces with low light.

Sonar sensor: The sonar sensors are used primarily in navigation for object detection, even for small objects, and generally are used in projects with a high budget because this type of sensors is very expensive. This sensor has high performances on the ground and in water for submersed robotics projects.

Laser sensor: A laser light is used for tracking and detection a target located at a long distance. The distance between sensor and target is measured by calculating the speed of light and the time since light is emitted and until it is returned to the receiver.

Image sensor: One combination for detection and tracking an object or detecting a human face is a webcam and the OpenCV vision software.

The in-situ sensing system (203) also includes communication modules to receive commands from and transmit sensor measurement data to the data gathering and analysis system (160) depicted in FIG. 1 above. For example, the commands and sensor measurement data may be transmitted using wired or wireless protocols, such as via the wireline, mud pulse telemetry, etc. The in-situ sensing system (203) further includes power modules to operate the sensors and the communication modules. The power modules may include batteries that are recharged via wireline from the surface or via other downhole power generation schemes.

FIG. 2B shows the intelligent drilling system B (200*b*) that is substantially the same as the intelligent drilling system A (200*a*) depicted in FIG. 2A above, but with different constructions of the inner drill pipe bearing systems. Specifically, in place of the inner drill pipe bearing system A (201) and the inner drill pipe bearing system B (211) having the same stationary rib construction, the intelligent drilling system B (200*b*) includes the inner drill pipe bearing system C (221) and the inner drill pipe bearing system D (231) that have the same rotating rib construction. As shown in FIG. 2B, the transversal cross-sectional view (221*d*) of the inner drill pipe bearing system C (221) shows that four ribs (221*c*) (referred to as bypass ribs) are fixed on the exterior wall of the inner drill pipe (201*a*). Accordingly, the ribs (221*c*) rotate with the inner drill pipe (201*a*) during drilling. The ribs (201*c*) protrude outwardly from the exterior wall of the inner drill pipe (201*a*) to connect to the bearing (221*b*). The external drill string pipe (202) connects to or acts as the outer ring of the bearing (221*b*). The bearing (221*b*) includes rolling elements (e.g., ball, roller, etc.) to allow the external drill string shield (202) and the inner drill pipe (201*a*) to rotate freely with respect to each other. Gaps (221*e*) between the ribs (201*c*) allow the drilling fluids to flow through the inner annular passage (206*a*). For example, the gaps (221*e*) may occupy up to 60% of the cross-section area within the external drill string shield (202).

Although FIGS. 2A and 3B show 4 bypass ribs in each inner drill pipe bearing system, any suitable number of bypass ribs greater or less than 4 may exist in one or more inner drill pipe bearing systems of other embodiments. Further, although FIGS. 2A and 3B show ball bearings used in each inner drill pipe bearing system, other types of bearings such as a tapered roller bearing may also be used in one or more inner drill pipe bearing systems of other embodiments. As an example, FIG. 2C sows an inner drill pipe bearing system E (241) using a tapered roller bearing. As shown in FIG. 2C, the inner drill pipe bearing system E (241) includes an external drill string shield (202*a*) having a tapered section (241*a*) to accommodate a tapered roller bearing (241*b*). A portion of the tapered roller bearing (241*b*) is illustrated in the expanded view (241) to show tapered roller pins (e.g., tapered roller pin (241*e*)). Similar to the transversal cross-sectional view (221*d*) of the inner drill pipe bearing system C (221) depicted in FIG. 2B above, the transversal cross-sectional view (241*d*) of the inner drill pipe bearing system E (241) shows that four bypass ribs (241*c*) are fixed on the exterior wall of the inner drill pipe (201*a*). In such rotating rib construction where the tapered surface in the tapered section (241*a*) rests on the tapered roller bearing (241*b*) fixed to the inner drill pipe (201*a*) via the bypass ribs (241*c*), the tapered roller bearing (241*b*) holds the weight of the external drill string shield (202*a*) on the axial/longitudinal direction and decouples the external drill string shield (202*a*) from the rotational motion of the inner drill pipe (201*a*) in the radial/transversal direction. In some embodiments, the entire weight of the external drill string shield (202*a*) is supported by the tapered roller bearing (241*b*) such that the external drill string shield (202*a*) extends and overlaps only a downhole portion of the inner drill pipe (201*a*) without reaching to the Earth surface.

Figure 3:
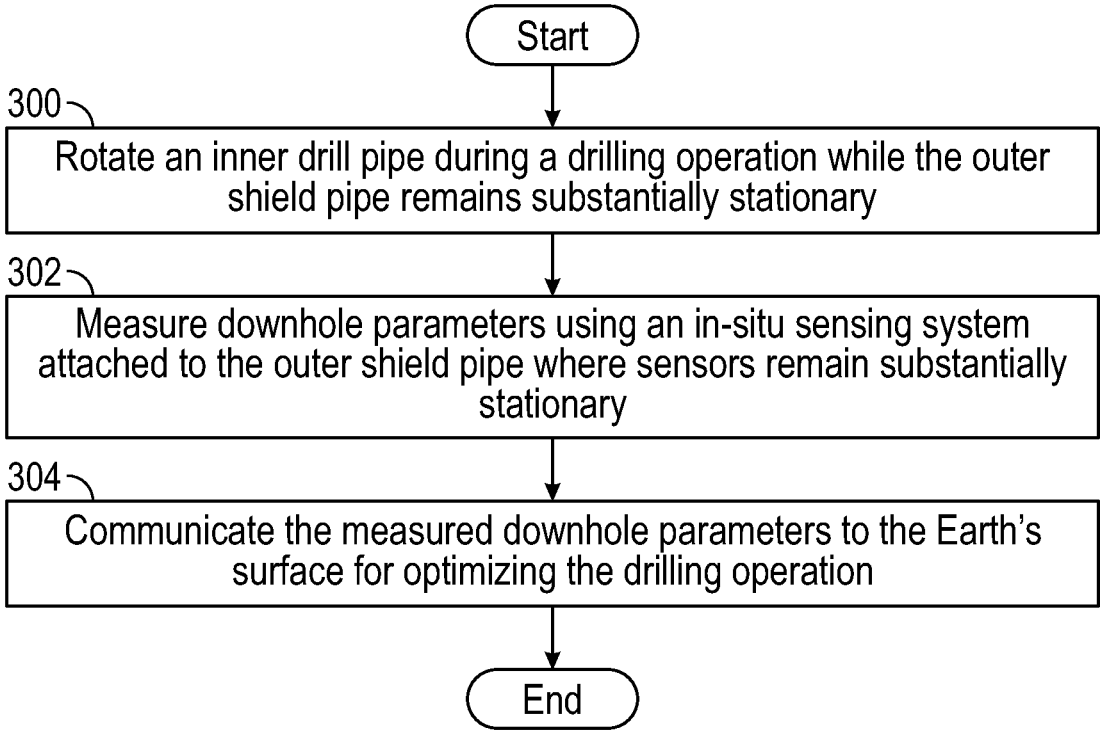
FIG. 3 shows a flowchart in accordance with one or more embodiments.

FIG. 3 shows a flowchart in accordance with one or more embodiments disclosed herein. One or more of the steps in FIG. 3 may be performed by the components of the well environment (100), in particular the rig (101), downhole sensor (153), and data gathering and analysis system (160), discussed above in reference to FIGS. 1 and 2A-2C. In one or more embodiments, one or more of the steps shown in FIG. 3 may be omitted, repeated, and/or performed in a different order than the order shown in FIG. 3. Accordingly, the scope of the disclosure should not be considered limited to the specific arrangement of steps shown in FIG. 3.

Referring to FIG. 3, initially in Step 300, an inner drill pipe is rotated while the outer shield pipe (i.e., external drill string shield) remains substantially stationary.

In Step 302, downhole parameters are measured using an in-situ sensing system attached to the outer shield pipe where sensors remain substantially stationary. For example, the measured data may include drilling fluid parameters that are measured from cuttings in the drilling fluids passing by the in-situ sensing system during a drilling operation.

In Step 304, the measured downhole parameters are communicated to the Earth's surface for optimizing the drilling operation.

Embodiments may include a combination of stationary rib construction and rotating rib construction for the top and bottom bearing systems, or a combination of ball bearing and tapered roller bearing for the top and bottom bearing systems. For example, the top bearing system may have a stationary rib construction while the bottom bearing system may have a rotating rib construction, and vice versa. In another example, the top bearing system may use a ball bearing while the bottom bearing system may use a tapered roller bearing, and vice versa.

Figure 4:
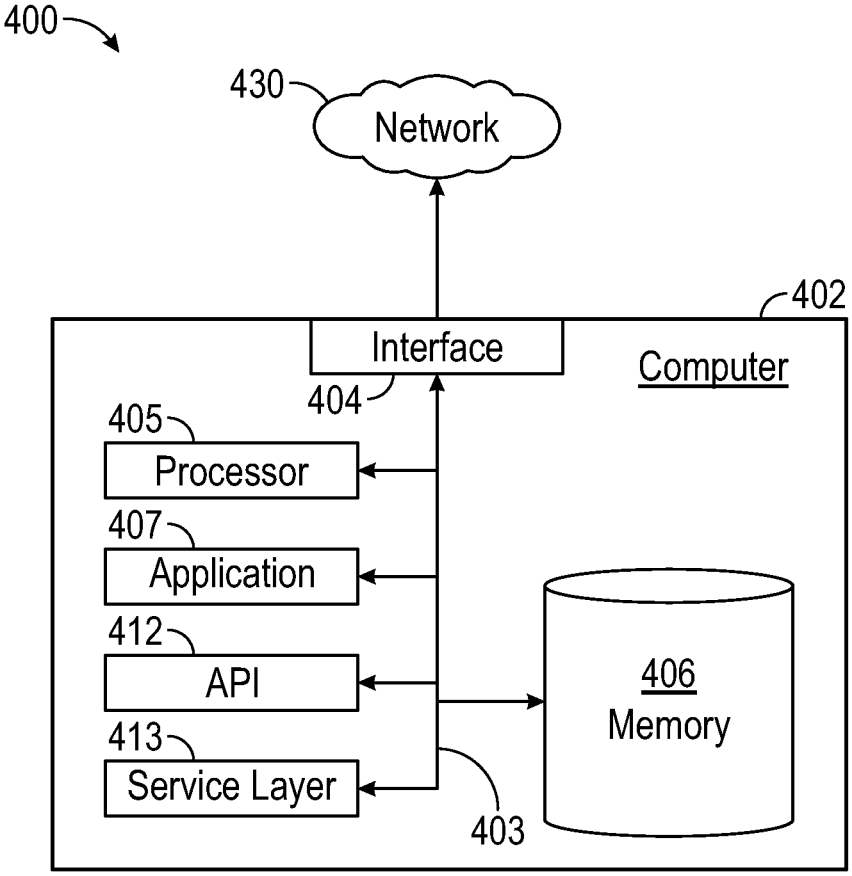
FIG. 4 shows a computing device in accordance with one or more embodiments.

Embodiments may be implemented on a computing device. For example, the in-situ sensing system (203) and data gathering and analysis system (160) may be implemented on a computer device. FIG. 4 depicts a block diagram) of a computing device (400) including a computer (402) used to provide computational functionalities associated with described machine learning networks, algorithms, methods, functions, processes, flows, and procedures as described in this disclosure, according to one or more embodiments. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols, such as the Wellsite Information Transfer Specification (WITS) protocol, associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing a computer (402), wherein each computer (402) communicates over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

While the invention has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed:

1. An intelligent drilling system, comprising:

an inner drill pipe adapted to rotate around a longitudinal axis in a transversal plane of a wellbore to advance a drill bit during a drilling operation;

an external drill string shield surrounding the inner drill pipe and coupled to the inner drill pipe via at least one bearing system;

the at least one bearing system adapted to decouple the external drill string shield from a rotational motion of the inner drill pipe in the transversal plane such that the external drill string shield remains substantially stationary during the drilling operation; and an in-situ sensing system disposed on an interior wall of the external drill string shield to measure at least one downhole parameter of the wellbore, wherein the at least one bearing system comprises:

at least one bypass rib fixed on and protrudes from an interior wall of the external drill string shield; and a plurality of rolling elements disposed between the at least one bypass rib and an exterior wall of the inner drill pipe, wherein the at least one bypass rib remains substantially stationary with the external drill string shield during the drilling operation, wherein the at least one bypass rib defines an opening to allow drilling fluids to flow through the at least one bearing system, and wherein the external drill string shield is decoupled from the rotational motion of the inner drill pipe via the plurality of rolling elements.

2. The intelligent drilling system of claim 1, the in-situ sensing system comprising:

at least one sensor to generate a measurement data representing the at least one downhole parameter; and a communication module to transmit the measurement data to a data gathering and analysis system located at Earth surface, wherein the data gathering and analysis system facilitates the drilling operation based at least on the measurement data.

3. The intelligent drilling system of claim 2, wherein the measurement data represents one or more of downhole temperature, downhole pressure, and cuttings evaluation information.

4. An intelligent drilling system, comprising:

an inner drill pipe adapted to rotate around a longitudinal axis in a transversal plane of a wellbore to advance a drill bit during a drilling operation;

an external drill string shield surrounding the inner drill pipe and coupled to the inner drill pipe via at least one bearing system;

the at least one bearing system adapted to decouple the external drill string shield from a rotational motion of the inner drill pipe in the transversal plane such that the external drill string shield remains substantially stationary during the drilling operation; and an in-situ sensing system disposed on an interior wall of the external drill string shield to measure at least one downhole parameter of the wellbore, wherein the at least one bearing system comprises:

at least one bypass rib fixed on and protrudes from an exterior wall of the inner drill pipe; and a plurality of rolling elements disposed between the at least one bypass rib and an interior wall of the external drill string shield, wherein the at least one bypass rib rotates with the inner drill pipe during the drilling operation, wherein the at least one bypass rib defines an opening to allow drilling fluids to flow through the at least one bearing system, and wherein the external drill string shield is decoupled from the rotational motion of the inner drill pipe via the plurality of rolling elements.

5. The intelligent drilling system of claim 4, wherein the plurality of rolling elements comprise rolling balls.

6. The intelligent drilling system of claim 4, wherein the plurality of rolling elements comprise tapered roller pins that support a weight of the external drill string shield via a tapered surface of the external drill string shield, wherein the external drill string shield and the inner drill pipe are further coupled via the tapered roller pins against the tapered surface to advance downward together during the drilling operation.

7. A rig for drilling a wellbore, comprising:

a drilling fluid tank for storing drilling fluids, and an intelligent drilling system, comprising:

an inner drill pipe adapted to rotate around a longitudinal axis in a transversal plane of a wellbore to advance a drill bit during a drilling operation;

an external drill string shield surrounding the inner drill pipe and coupled to the inner drill pipe via at least one bearing system;

the at least one bearing system adapted to decouple the external drill string shield from a rotational motion of the inner drill pipe in the transversal plane such that the external drill string shield remains substantially stationary during the drilling operation; and an in-situ sensing system disposed on an interior wall of the external drill string shield to measure at least one downhole parameter of the wellbore, wherein the drilling fluids flow downward from the drilling fluid tank through the inner drill pipe to the drill bit, wherein the drilling fluids flow upward to return to the drilling fluid tank through an inner annular passage between the inner drill pipe and the external drill string shield and an outer annular passage between the external drill string shield and an interior wall of the wellbore, and wherein the in-situ sensing system measures the at least one downhole parameter from the drilling fluids flowing through the inner annular passage, wherein the at least one bearing system comprises:

at least one bypass rib fixed on and protrudes from an interior wall of the external drill string shield; and a plurality of rolling elements disposed between the at least one bypass rib and an exterior wall of the inner drill pipe, wherein the at least one bypass rib remains substantially stationary with the external drill string shield during the drilling operation, wherein the at least one bypass rib defines an opening to allow drilling fluids to flow through the at least one bearing system, and wherein the external drill string shield is decoupled from the rotational motion of the inner drill pipe via the plurality of rolling elements.

8. The rig of claim 7, the in-situ sensing system comprising:

at least one sensor to generate a measurement data representing the at least one downhole parameter; and a communication module to transmit the measurement data to a data gathering and analysis system located at Earth surface, wherein the data gathering and analysis system facilitates the drilling operation based at least on the measurement data.

9. The rig of claim 8, wherein the measurement data represents one or more of downhole temperature, downhole pressure, and cuttings evaluation information.

10. A rig for drilling a wellbore, comprising:

a drilling fluid tank for storing drilling fluids, and an intelligent drilling system, comprising:

an inner drill pipe adapted to rotate around a longitudinal axis in a transversal plane of a wellbore to advance a drill bit during a drilling operation;

an external drill string shield surrounding the inner drill pipe and coupled to the inner drill pipe via at least one bearing system;

the at least one bearing system adapted to decouple the external drill string shield from a rotational motion of the inner drill pipe in the transversal plane such that the external drill string shield remains substantially stationary during the drilling operation; and an in-situ sensing system disposed on an interior wall of the external drill string shield to measure at least one downhole parameter of the wellbore, wherein the drilling fluids flow downward from the drilling fluid tank through the inner drill pipe to the drill bit, wherein the drilling fluids flow upward to return to the drilling fluid tank through an inner annular passage between the inner drill pipe and the external drill string shield and an outer annular passage between the external drill string shield and an interior wall of the wellbore, wherein the in-situ sensing system measures the at least one downhole parameter from the drilling fluids flowing through the inner annular passage, wherein the at least one bearing system comprises:

at least one bypass rib fixed on and protrudes from an exterior wall of the inner drill pipe; and a plurality of rolling elements disposed between the at least one bypass rib and an interior wall of the external drill string shield, wherein the at least one bypass rib rotates with the inner drill pipe during the drilling operation, wherein the at least one bypass rib defines an opening to allow drilling fluids to flow through the at least one bearing system, and wherein the external drill string shield is decoupled from the rotational motion of the inner drill pipe via the plurality of rolling elements.

11. The rig of claim 10, wherein the plurality of rolling elements comprise rolling balls.

12. The rig of claim 10, wherein the plurality of rolling elements comprise tapered roller pins that support a weight of the external drill string shield via a tapered surface of the external drill string shield, wherein the external drill string shield and the inner drill pipe are further coupled via the tapered roller pins against the tapered surface to advance downward together during the drilling operation.

13. A system comprising:

a wellsite having a wellbore penetrating a subterranean formation in a field;

a rig for drilling the wellbore, comprising:

a drilling fluid tank for storing drilling fluids, and an intelligent drilling system, comprising:

an inner drill pipe adapted to rotate around a longitudinal axis in a transversal plane of a wellbore to advance a drill bit during a drilling operation;

an external drill string shield surrounding the inner drill pipe and coupled to the inner drill pipe via at least one bearing system;

the at least one bearing system adapted to decouple the external drill string shield from a rotational motion of the inner drill pipe in the transversal plane such that the external drill string shield remains substantially stationary during the drilling operation; and an in-situ sensing system disposed on an interior wall of the external drill string shield to measure at least one downhole parameter of the wellbore, wherein the drilling fluids flow downward from the drilling fluid tank through the inner drill pipe to the drill bit, wherein the drilling fluids flow upwards to return to the drilling fluid tank through an inner annular passage between the inner drill pipe and the external drill string shield and an outer annular passage between the external drill string shield and an interior wall of the wellbore, and wherein the in-situ sensing system measures the at least one downhole parameter from the drilling fluids flowing through the inner annular passage; and a data gathering and analysis system configured to facilitate the drilling operation based on the at least one downhole parameter measured by the in-situ sensing system, wherein the at least one bearing system comprises:

at least one bypass rib fixed on and protrudes from an interior wall of the external drill string shield; and a plurality of rolling elements disposed between the at least one bypass rib and an exterior wall of the inner drill pipe, wherein the at least one bypass rib remains substantially stationary with the external drill string shield during the drilling operation, wherein the at least one bypass rib defines an opening to allow drilling fluids to flow through the at least one bearing system, and wherein the external drill string shield is decoupled from the rotational motion of the inner drill pipe via the plurality of rolling elements.

14. The system of claim 13, the in-situ sensing system comprising:

at least one sensor to generate a measurement data representing the at least one downhole parameter; and a communication module to transmit the measurement data to the data gathering and analysis system located at Earth surface, wherein the data gathering and analysis system facilitates the drilling operation based at least on the measurement data.

15. The system of claim 14, wherein the measurement data represents one or more of downhole temperature, downhole pressure, and cuttings evaluation information.

16. A system comprising:

a wellsite having a wellbore penetrating a subterranean formation in a field;

a rig for drilling the wellbore, comprising:

a drilling fluid tank for storing drilling fluids, and an intelligent drilling system, comprising:

an inner drill pipe adapted to rotate around a longitudinal axis in a transversal plane of a wellbore to advance a drill bit during a drilling operation;

an external drill string shield surrounding the inner drill pipe and coupled to the inner drill pipe via at least one bearing system;

the at least one bearing system adapted to decouple the external drill string shield from a rotational motion of the inner drill pipe in the transversal plane such that the external drill string shield remains substantially stationary during the drilling operation; and an in-situ sensing system disposed on an interior wall of the external drill string shield to measure at least one downhole parameter of the wellbore, wherein the drilling fluids flow downward from the drilling fluid tank through the inner drill pipe to the drill bit, wherein the drilling fluids flow upwards to return to the drilling fluid tank through an inner annular passage between the inner drill pipe and the external drill string shield and an outer annular passage between the external drill string shield and an interior wall of the wellbore, and wherein the in-situ sensing system measures the at least one downhole parameter from the drilling fluids flowing through the inner annular passage; and a data gathering and analysis system configured to facilitate the drilling operation based on the at least one downhole parameter measured by the in-situ sensing system, wherein the at least one bearing system comprises:

at least one bypass rib fixed on and protrudes from an exterior wall of the inner drill pipe; and a plurality of rolling elements disposed between the at least one bypass rib and an interior wall of the external drill string shield, wherein the at least one bypass rib rotates with the inner drill pipe during the drilling operation, wherein the at least one bypass rib defines an opening to allow drilling fluids to flow through the at least one bearing system, and wherein the external drill string shield is decoupled from the rotational motion of the inner drill pipe via the plurality of rolling elements.

17. The system of claim 16, wherein the plurality of rolling elements comprise tapered roller pins that support a weight of the external drill string shield via a tapered surface of the external drill string shield, wherein the external drill string shield and the inner drill pipe are further coupled via the tapered roller pins against the tapered surface to advance downward together during the drilling operation.

* * * * *